US009037385B2

(12) United States Patent
Maki et al.

(10) Patent No.: US 9,037,385 B2
(45) Date of Patent: May 19, 2015

(54) ENGINE SPEED CONTROL DEVICE AND ENGINE SPEED CONTROL METHOD

(75) Inventors: Kazuhiro Maki, Tokyo (JP); Yukiko Suzuki, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 780 days.

(21) Appl. No.: 13/387,459

(22) PCT Filed: Apr. 13, 2010

(86) PCT No.: PCT/JP2010/056577

§ 371 (c)(1),
(2), (4) Date: Mar. 19, 2012

(87) PCT Pub. No.: WO2011/013415

PCT Pub. Date: Feb. 3, 2011

(65) Prior Publication Data

US 2012/0160211 A1 Jun. 28, 2012

(30) Foreign Application Priority Data

Jul. 31, 2009 (JP) ..... 2009-178614

(51) Int. Cl.
*F02D 31/00* (2006.01)
*F02M 3/09* (2006.01)
(Continued)

(52) U.S. Cl.
CPC ..... *F02M 3/09* (2013.01); *F02D 31/001* (2013.01); *F02D 2400/06* (2013.01);
(Continued)

(58) Field of Classification Search
CPC .. F02D 41/083; F02D 31/001; F02D 2400/06
USPC ..... 123/333, 339.6, 352, 361, 376; 701/110
See application file for complete search history.

(56) References Cited

U.S. PATENT DOCUMENTS 4,354,466 A * 10/1982 Dudley et al. ..... 123/339.18
4,779,591 A * 10/1988 Tordenmalm ..... 123/352
(Continued)

FOREIGN PATENT DOCUMENTS

CN 1603598 4/2005
CN 101285428 10/2008
(Continued)

OTHER PUBLICATIONS

Office Action issued Dec. 4, 2013 in corresponding Chinese Patent Application No. 201080028893.0 (with English translation).
(Continued)

*Primary Examiner* — Erick Solis
(74) *Attorney, Agent, or Firm* — Wenderoth, Lind & Ponack, L.L.P.

(57) ABSTRACT

Providing an engine speed control device and an engine speed control method, wherein the no-load condition of the farm working machine can be estimated independently of the farm working machine and a no-loading operation condition of the engine can be automatically shifted to an idling condition. An engine speed control device with which the engine drives a farm working machine, the engine speed control device provided with: a memory section 8 in which the throttle opening threshold levels corresponding to the target engine speeds are memorized; a first judgment device that reads out the throttle opening threshold level corresponding to the target engine speed from the memory device, and judges whether or not the current throttle opening threshold level is smaller than or equal to the throttle opening threshold level corresponding to the target engine speed; a target engine speed determining section 16 by which the target engine speed diminishes to a low idling engine speed in a case where the first judgment device judges that the current throttle opening threshold level is smaller than or equal to the throttle opening threshold level corresponding to the target engine speed; and, a throttle opening regulating device 14 that regulates the opening of the throttle valve based on the target engine speed.

11 Claims, 7 Drawing Sheets

(51) Int. Cl.

| | |
|---|---|
| ***F02D 29/00*** | (2006.01) |
| ***F02D 41/02*** | (2006.01) |
| ***F02D 41/08*** | (2006.01) |
| *F02D 11/10* | (2006.01) |

(52) U.S. Cl.

CPC ..... *F02D 11/106* (2013.01); *F02D 29/00* (2013.01); *F02D 31/003* (2013.01); *F02D 41/0205* (2013.01); *F02D 41/083* (2013.01)

(56) References Cited

U.S. PATENT DOCUMENTS

| | | | | |
|---|---|---|---|---|
| 5,353,762 | A * | 10/1994 | Dykstra et al. | 123/352 |
| 6,277,050 | B1 * | 8/2001 | Nakagawa et al. | 477/112 |
| 6,836,718 | B2 * | 12/2004 | Hasfjord et al. | 701/54 |
| 7,232,083 | B2 * | 6/2007 | Stelter et al. | 241/30 |
| 7,744,503 | B2 | 6/2010 | Kobayashi et al. | |
| 8,463,527 | B2 * | 6/2013 | Thorsen et al. | 701/103 |
| 2007/0169743 | A1 | 7/2007 | Kobayashi et al. | |
| 2008/0014096 | A1 * | 1/2008 | Gilpatrick | 417/34 |
| 2008/0178839 | A1 * | 7/2008 | Oshima et al. | 123/339.2 |
| 2011/0005024 | A1 * | 1/2011 | Spitler et al. | 15/320 |
| 2013/0112170 | A1 * | 5/2013 | Yamashita et al. | 123/406.23 |

FOREIGN PATENT DOCUMENTS

| | | |
|---|---|---|
| JP | 61-294152 | 12/1986 |
| JP | 62-99643 | 5/1987 |
| JP | 2-248631 | 10/1990 |
| JP | 6-84732 | 3/1994 |
| JP | 2816556 | 8/1998 |
| JP | 2006-342832 | 12/2006 |
| JP | 2009-115165 | 5/2009 |
| TW | I231839 | 5/2005 |
| TW | 200736496 | 10/2007 |
| TW | 200918737 | 5/2009 |

OTHER PUBLICATIONS

Notice of Allowance issued Dec. 4, 2013 in corresponding Korean Application No. 10-2011-7030864, with English translation.
Decision to Grant a Patent issued Nov. 15, 2013 in corresponding Japanese Application No. 2009-178614 (with English translation).
International Preliminary Report on Patentability and Written Opinion of the International Searching Authority issued Feb. 7, 2012 in corresponding International Application No. PCT/JP2010/056577.
Notice of Allowance issued Feb. 24, 2014 in corresponding Taiwanese Application No. 099112321, with English translation.
Office Action issued Mar. 25, 2013 in corresponding Taiwanese Application No. 099112321 (with English language translation).
International Search Report issued Jun. 1, 2010 in corresponding International Application No. PCT/JP2010/056577.

* cited by examiner

| | TARGET ENGINE SPEED [rpm] | | θ th_idle [STEP] |
|---|---|---|---|
| LOW-IDLE JUDGMENT | 2200 | | 48 |
| IDLING JUDGMENT | | ≦ 2000 | 48 |
| | > 2000 | ≦ 2250 | 49 |
| | > 2250 | ≦ 2500 | 51 |
| | > 2500 | ≦ 2750 | 53 |
| | > 2750 | ≦ 3000 | 58 |
| | > 3000 | ≦ 3250 | 59 |
| | > 3250 | ≦ 3500 | 59 |
| | > 3500 | ≦ 3750 | 59 |
| | > 3750 | | 61 |

S4: θth_idle = IDLING ESTIMATION THRESHOLD LEVEL

S6: IDLING ESTIMATION THRESHOLD LEVEL = θth+3

S8: TARGET SPEED IS DECREASED

S10: TARGET SPEED IS SET AT LOW IDLE SPEED

S12: IDLING ESTIMATION THRESHOLD = θth+3

S13: θth_idle = IDLING ESTIMATION THRESHOLD LEVEL

S18: THROTTLE VALVE IS

S21: DATA STORAGE IN NON-VOLATILE MEMORY

ENGINE SPEED CONTROL DEVICE AND ENGINE SPEED CONTROL METHOD

BACKGROUND OF THE INVENTION

1. Field of the Invention

The present invention relates to an engine speed control device and an engine speed control method; the present invention especially relates to the engine speed control device and the engine speed control method of a small size engine that is used for general purpose and is used as a power source of a machine such as a generator, a pump or a mower.

2. Background of the Invention

As a small size engine that is used for general purpose and is used as a power source of a machine such as a generator, a pump or a mower, an engine provided with an electric governor is conventionally known, the throttle valve of the carburetor in the engine being operated by an actuator. In this specification, the machine such as described just above is to be called a farm working machine.

The small size general-purpose engine provided with the electric governor is operated so that the engine speed is maintained at a constant level by regulating the fuel injection rate (almost equivalent to the engine torque T) corresponding to the engine speed even when the engine load changes. To be more specific, the electric governor controls the opening of the throttle valve by use of a feedback control manner in which the fuel injection rate is increased or decreased so as to eliminate the difference between the established target engine-speed and the actual engine speed.

In the small size general-purpose engine driving such a farm working machine as is described above, when the power demand from the farm working machine is zero while the engine is rotated, namely, when the rotating engine generates no load while the movement of the farm working machine is temporarily suspended, it is desirable to improve the fuel consumption and reduce the engine noises by reducing the engine speed.

Patent Reference 1, for instance, discloses a gasoline engine in which an electric governor regulates the opening of the throttle so that the engine speed is maintained at an idling speed in a case where a switch to detect an idling down (slow-down) order is set at the idling down position.

Further, Patent References 2 as well as 3 discloses a technology regarding idling speed control, although each patent Reference does not assume that the engine disclosed in each patent Reference is connected to a farm working machine as described above.

Patent Reference 2 discloses an idling speed control device of an engine provided with an alternator control device that maintains the field current in the alternator driven by the engine, at a prescribed current level regardless of the fluctuations in the electric load, when a learning-correcting device is activated.

Further, Patent Reference 3 discloses an idling speed control method in which the internal combustion engine performs a feedback control so that the adding-subtracting correction term is established at an appropriate level in response to the loading condition in real time.

In the technology of Patent Reference 3, whether the engine is operated in a loading condition or in no load condition is judged, for instance, based on whether the selector position regarding the automatic transmission of a fluid coupling is placed in a neutral range or in a drive range.

REFERENCES

Patent References

Patent Reference 1: JP2816556
Patent Reference 2: JP1994-84732
Patent Reference 3: JP1986-294152

SUMMARY OF THE INVENTION

Subjects to be Solved

In a farm working machine, however, it is necessary to judge whether or not the machine is operated in no load condition, in order to reduce the engine speed to an idling speed while the machine is placed in no load condition.

Thus, as described in Patent Reference 1, in the gasoline engine provided with the electric governor, the switch to detect an idling down (slow-down) order is linked with a stopping device to stop the farm working machine. In this way, in the technology of Patent Reference 1, the idling down process is performed based on the information regarding the load condition, the information being outputted from the machine; accordingly, the configuration becomes complicated.

Further, in the technology of Patent Reference 1, an operator of the machine is supposed to manually regulate the switch to detect an idling down (slow-down) order so that the engine is operated at an idling speed; thus, the efficiency of the operator is reduced; particularly in a case where the load conditions of the farm working machine frequently change, not only is the efficiency of the operator reduced but also it becomes difficult to appropriately change-over the switch in response to the load fluctuations.

Further, according to the technologies disclosed in Patent References 2 and 3, each technology does not assume that the engine disclosed in each patent Reference is connected to a farm working machine; thus, the engine cannot be placed in an idling speed condition in response to the loading conditions of the driven machine.

In view of the above-described difficulties in the conventional technologies, the present invention aims at providing an engine speed control device and an engine control method, wherein the no load condition of the farm working machine can be detected independently of the machine, and the no load condition is automatically changed-over into an idling speed operation.

Means to Solve the Subjects

In order to overcome the difficulties in the conventional technologies, the present invention discloses an engine speed control device for driving a farm working machine, the engine speed control device including, but not limited to:

a memory device in which a throttle opening threshold level corresponding to a target engine speed is memorized;

a first judgment device which reads out the throttle opening threshold level corresponding to the target engine speed from the memory device, and judges whether or not a current throttle opening threshold level is smaller than or equal to the throttle opening threshold level corresponding to the target engine speed;

a target engine speed changing device by which the target engine speed diminishes to a low idling engine speed in a case where the first judgment device judges that the current throttle opening threshold level is smaller than or equal to the throttle opening threshold level corresponding to the target engine speed; and a throttle opening regulating device which regulates an opening of an throttle valve based on the target engine speed.

According to the engine speed control device as described above, the no-load condition of the farm working machine can be estimated independently of the farm working machine; thus, an electric system for transferring signals between the engine and the farm working machine or a sensor for detecting the no-load condition can be dispensed with; and, the engine speed control device can be simply configured.

Further, based on the judgment of the no-load condition regarding the farm working machine, the target engine-speed is automatically changed and the opening of throttle valve is regulated; thus, a no-loading operation condition of the engine can be automatically shifted to an idling condition. In other words, the operator can dispense with the idle-down manipulation for placing the engine in an idling operation condition; and, the efficiency of the operator can be enhanced.

It is hereby noted that the low idling engine speed means a minimum engine speed at which the engine coupled with the farm working machine is stably operated in no-load condition without stalling.

A preferable embodiment of the present invention is the engine speed control device further including, but not limited to, a first learning device which updates the throttle opening threshold level corresponding to the target engine speed in a case where the first judgment device judges that the current throttle opening threshold level is smaller than or equal to the throttle opening threshold level corresponding to the target engine speed, so that the throttle opening threshold level corresponding to the target engine speed is replaced by the level which is obtained by adding a value greater than an average deviation of throttle opening levels to the current throttle opening threshold level.

As described above, the throttle opening threshold level corresponding to the target engine speed is always updated and learned while the engine coupled with the farm working machine is operated; the accuracy regarding the no-load estimation can be enhanced independently from the farm working machine.

Further, even when the accuracy regarding the no-load estimation is deteriorated by the secular change of the engine or the farm working machine, the accuracy can be maintained.

Incidentally, the average deviation regarding the throttle opening levels means the width of fluctuation range regarding the throttle opening levels; and, the average deviation can be computed by use of the actual values of the throttle opening levels (e.g. by use of the law of statistical probability distribution (the deviation $\sigma$, $2\sigma$ and so on)).

Another preferable embodiment of the present invention is the engine speed control device, wherein the throttle opening threshold level which is obtained in a case where the target engine speed becomes equal to the low idling engine speed is set as a second throttle opening threshold level, and the engine speed control device further comprises a second judgment device which judges whether or not the current throttle opening threshold level is greater than or equal to the level which is obtained by adding a value greater than an average deviation of throttle opening levels to the second throttle opening threshold level, and wherein the target engine speed changing device makes the target engine speed increase in a case where the second judgment device judges that the current throttle opening threshold level is greater than or equal to the level which is obtained by adding a value greater than an average deviation of throttle opening levels to the second throttle opening threshold level.

As described above, in a case where a load is suddenly applied on the farm working machine during the idling operation, the idling operation can be immediately finished and changed into an ordinary operation.

Another preferable embodiment of the present invention is the engine speed control device further including, but not limited to:

a switch which inputs whether or not the farm working machine is in a no-load condition; and a second learning device which, in a case where the no-load condition is inputted by the switch, updates the throttle opening threshold level corresponding to the target engine speed to the level which is obtained by adding a value greater than an average deviation of throttle opening levels to the current throttle opening threshold level, and updates the second throttle opening threshold level to the current throttle opening threshold level.

As described above, the throttle opening threshold level can be renewed and replaced into an appropriate level, by use of the switch that used for judging that the farm working machine is in a no-load condition.

In general, when the engine is used for an extended period, the power that the engine can produce is decreased; thus, the throttle opening level for the idling operation has to be gradually increased. Hence, the throttle opening level established at the shipment of the engine is not always the correct setting level during the period after the engine is delivered.

Further, in a case where the friction change (e.g. due to bearing characteristic change) between the engine and the farm working machine is suddenly and greatly changed after the engine is stored for a long period, there may be also a possibility that the throttle opening threshold level which is learned in the previous machine operation becomes no more correct, as there is no renewal or no learning regarding the throttle opening threshold level during the long period of the storage.

Accordingly, by use of the above-described switch, the current throttle opening threshold level is renewed and replaced by new one in response to the latest engine condition.

In this way, even when the no load estimation criterion is changed because of the secular change of the engine, the accuracy regarding the no load estimation can be maintained.

In addition, the switch used for inputting the information that the engine is placed in no load condition may be configured independently of a switch for changing the engine-speed maintaining-condition into the engine-speed changing-condition or vice versa; or the former switch and the latter switch may be integrated into one switch. Even when two switches are integrated into one switch, it is possible that the functions of both the switches can be separately performed by appropriately handling the integrated one switch.

Another preferable embodiment of the present invention is the engine speed control device, wherein the memory device is a volatile memory, whereas the engine speed control device is provided with a nonvolatile memory which memories the throttle opening threshold levels corresponding to the target engine speed and the second throttle opening threshold levels.

As describe above, when the engine is placed in a stop condition, the throttle opening thresholds corresponding to the target engine speed and the learned data can be stored and maintained. In addition, even when the engine is placed in a stop condition, the throttle opening threshold levels in response to the target engine-speeds as well as the renewed data updated by the learning function can be reserved; further, the data renewal (and reservation) frequency regarding the nonvolatile memory can be reduced.

Another preferable embodiment of the present invention is an engine provided with the engine speed control device according to the present invention as described thus far.

According to the engine as described above, the no-load condition of the farm working machine can be estimated independently of the farm working machine; thus, an electric system for transferring signals between the engine and the farm working machine or a sensor for detecting the no-load condition can be dispensed with; and, the engine speed control device can be simply configured.

Further, based on the judgment of the no-load condition regarding the farm working machine, the target engine-speed is automatically changed and the opening of throttle valve is regulated; thus, a no-loading operation condition of the engine can be automatically shifted to an idling condition. In other words, the operator can dispense with the idle-down manipulation for placing the engine in an idling operation condition; and, the efficiency of the operator can be enhanced.

The present invention further discloses an engine speed control method for driving a farm working machine, the engine speed control method including, but not limited to, the steps of:

performing a memorizing process in which a throttle opening threshold level corresponding to a target engine speed is previously memorized in a memory device;

performing a first judgment process in which the throttle opening threshold level corresponding to the target engine speed is read-out from the memory device, and it is judged whether or not a current throttle opening threshold level is smaller than or equal to the throttle opening threshold level corresponding to the target engine speed;

performing a first target engine speed changing process in which the target engine speed diminishes to a low idling engine speed in a case where it is judged, in the first judgment process, that the current throttle opening threshold level is smaller than or equal to the throttle opening threshold level corresponding to the target engine speed; and performing a throttle opening regulating process in which an opening of the throttle valve is regulated based on the target engine speed.

According to the engine-speed control method as described above, the no-load condition of the farm working machine can be estimated independently of the farm working machine; thus, an electric system for transferring signals between the engine and the farm working machine or a sensor for detecting the no-load condition can be dispensed with; and, the engine speed control device can be simply configured.

Further, based on the judgment of the no-load condition regarding the farm working machine, the target engine-speed is automatically changed and the opening of throttle valve is regulated; thus, a no-loading operation condition of the engine can be automatically shifted to an idling condition. In other words, the operator can dispense with the idle-down manipulation for placing the engine in an idling operation condition; and, the efficiency of the operator can be enhanced.

A preferable embodiment of the present invention as described above is the engine speed control method further including, but not limited to, the steps of performing a first learning process in which the throttle opening threshold level corresponding to the target engine speed is updated in a case where it is judged, in the first judgment process, that the current throttle opening threshold level is smaller than or equal to the throttle opening threshold level corresponding to the target engine speed, so that the throttle opening threshold level corresponding to the target engine speed is replaced by the level that is obtained by adding a value greater than an average deviation of throttle opening levels to the current throttle opening threshold level.

As described above, the throttle opening threshold level corresponding to the target engine speed is always updated and learned while the engine coupled with the farm working machine is operated; the accuracy regarding the no-load estimation can be enhanced independently from the farm working machine.

Further, even when the accuracy regarding the no-load estimation is deteriorated by the secular change of the engine or the farm working machine, the accuracy can be maintained.

Another preferable embodiment of the present invention is the engine speed control method further including, but not limited to, the steps of:

performing a second judgment process in which the throttle opening threshold level which is obtained in a case where the target engine speed becomes equal to the low idling engine speed is set as a second throttle opening threshold level, and it is judged whether the current throttle opening threshold level is greater than or equal to the level which is obtained by adding a value greater than an average deviation of throttle opening levels to the second throttle opening threshold level; and in the second judgment process, the target engine speed is increased in a case where it is judged, that the current throttle opening threshold level is greater than or equal to the level that is obtained by adding a value greater than an average deviation of throttle opening levels to the second throttle opening threshold level.

As described above, in a case where a load is suddenly applied on the farm working machine during the idling operation, the idling operation can be immediately finished and changed into an ordinary operation.

Another preferable embodiment of the present invention is the engine speed control method, wherein the farm working machine comprises a switch which inputs whether or not the farm working machine is in a no-load condition, performing the second learning process in which, in a case where no-load condition is inputted by the switch, the throttle opening threshold level corresponding to the target engine speed is updated to the level which is obtained by adding a value greater than an average deviation of throttle opening levels to the current throttle opening threshold level, and the second throttle opening threshold level is updated to the current throttle opening threshold level.

As described above, the throttle opening threshold level can be renewed and replaced into an appropriate level, by use of the switch that used for judging that the farm working machine is in a no-load condition. In this way, even when the no load estimation criterion is changed because of the secular change of the engine, the accuracy regarding the no load estimation can be maintained.

Another preferable embodiment of the present invention is the engine speed control method including, in the memorizing process, the throttle opening threshold level corresponding to a target engine speeds is memorized by using a volatile memory; and the throttle opening threshold levels corresponding to the target engine speed and the second throttle opening threshold levels are memorized by using a nonvolatile memory elements different from the volatile memory.

As describe above, when the engine is placed in a stop condition, the throttle opening thresholds corresponding to the target engine speed and the learned data can be stored and maintained. In addition, even when the engine is placed in a stop condition, the throttle opening threshold levels in response to the target engine-speeds as well as the renewed data updated by the learning function can be reserved; further, the data renewal (and reservation) frequency regarding the nonvolatile memory can be reduced.

Effects of the Invention

According to the present invention, the no-load condition of the farm working machine can be estimated independently of the farm working machine; thus, an electric system for transferring signals between the engine and the farm working machine or a sensor for detecting the no-load condition can be dispensed with; and, the engine speed control device can be simply configured.

Further, based on the judgment of the no-load condition regarding the farm working machine, the target engine-speed is automatically changed and the opening of throttle valve is regulated; thus, a no-loading operation condition of the engine can be automatically shifted to an idling condition. In other words, the operator can dispense with the idle-down manipulation for placing the engine in an idling operation condition; and, the efficiency of the operator can be enhanced.

Accordingly, the no-load condition of the farm working machine can be estimated independently of the farm working machine; thus, a no-loading operation condition of the engine can be automatically shifted to an idling condition.

DETAILED DESCRIPTION OF THE PREFERRED MODES (First Mode)

Hereafter, the present invention will be described in detail with reference to the modes or embodiments shown in the figures. However, the dimensions, materials, shape, the relative placement and so on of a component described in these modes or embodiments shall not be construed as limiting the scope of the invention thereto, unless especially specific mention is made.

Figure 1:
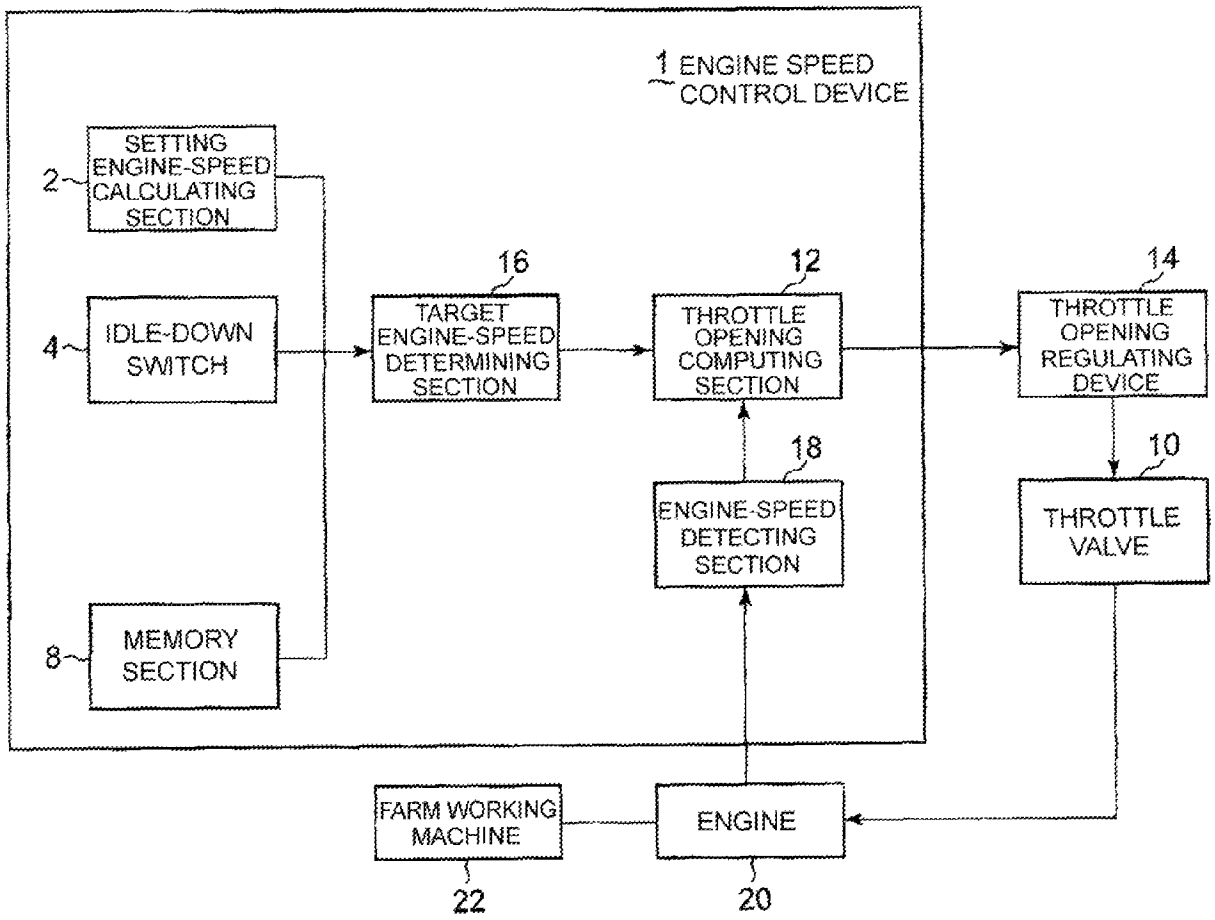
FIG. 1 shows a block diagram that depicts an engine speed control device according to a first mode of the present invention.
Figures 2, 3:
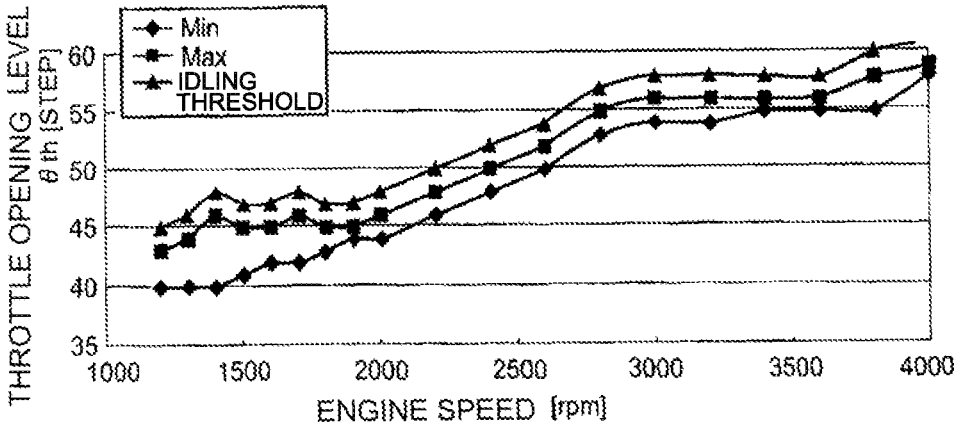
FIG. 2 shows an exemplar setting regarding the throttle opening thresholds in response to the target engine speeds.
FIG. 3 shows the actual throttle openings in response to the engine speeds during the no load conditions of the farm working machine.
Figure 4:
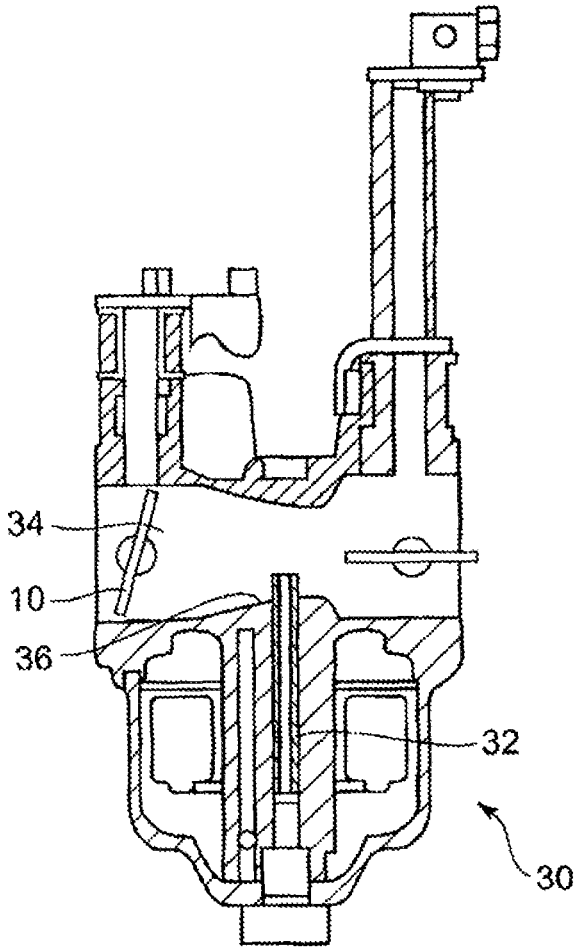
FIG. 4 shows a longitudinal cross-section of a carburetor provided with a throttle valve.

FIG. 1 shows a block diagram that depicts an engine speed control device according to a first mode of the present invention; FIG. 2 shows an exemplar setting regarding the throttle opening thresholds in response to the target engine speeds, the setting data of FIG. 2 being stored in a memory section 8 as shown in FIG. 2; FIG. 3 shows the actual throttle openings in response to the engine speeds during the no load conditions of the farm working machine; FIG. 4 shows a longitudinal cross-section of a carburetor provided with a throttle valve.

An engine speed control device 1 as shown in FIG. 1 controls the engine speed of an engine 20 driving a farm working machine 22.

The engine speed control device 1 is configured with:

- a setting engine-speed calculating section 2 for computing a setting engine-speed of the engine 20;
- an idle-down switch 4 for determining whether or not the idle-down control is performed;
- the memory section 8 for storing a setting data regarding the throttle opening thresholds in response to the target engine speeds;
- a target engine-speed determining section 16 for determining the target engine-speed of an engine 20;
- an engine-speed detecting section 18 for detecting the actual engine speed of the engine 20;
- a throttle opening computing section 12 for computing the opening of a throttle valve.

The setting engine-speed calculating section 2 computes a target engine-speed (i.e. a setting engine-speed or an ordinary operation speed) of the engine 20 in an ordinal operation condition of the farm working machine 22.

In a case of a general farm working machine, the ordinary operation speed is a fixed speed at a constant level; however, an operator of the machine can usually compute the speed by manipulating the throttle.

In the memory section 8, the data regarding the throttle opening thresholds in response to the target engine speeds is memorized; for instance, such a table as is shown in FIG. 2 may be memorized in the memory section, the table including the data in which the throttle opening threshold is determined in response to every target engine speed range. Thereby, the low idle speed as an example level is set at 2200 rpm. The detail of the table will be described later; in this first mode of the invention, when the current (actual) throttle opening is smaller than or equal to a throttle opening threshold in response to the target engine-speed, it is judged that the farm working machine 22 is operated in the no-load condition.

The table of FIG. 2 can be obtained based on the actually measured throttle opening of the throttle valve 10, the throttle opening being measured while the speed of the engine 20 is changed in the no-load condition regarding the farm working machine 22. As shown in FIG. 3, for instance, while the speed of the engine 20 is changed in the no-load condition regarding the farm working machine 22, the throttle openings are measured; the measured openings may vary from the minimum level to the maximum level 102 at each engine speed; and, a throttle opening threshold level 100 at the engine speed may be determined so that the throttle opening threshold level 100 is a level exceeding the maximum level 102.

Incidentally, although the throttle opening threshold levels are to be predetermined based on the actually measured throttle opening levels, the measured levels vary from a farm working machine to another farm working machine (in response to the individual difference between the machines); hence, it is desirable that the table regarding the throttle opening thresholds is not a fixed type table but a table in which the data thereof is appropriately renewed by use of a learning function.

The type of the memory section 8 is not limited to any special type so long as the memory section 8 can memorize the throttle opening thresholds and reserve the renewed data updated by the learning function; for instance, volatile memory and nonvolatile memory may be arranged in the memory section 8 at the same time. In this way, even when the engine 20 is placed in a stop condition, the throttle opening threshold levels in response to the target engine-speeds as well as the renewed data updated by the learning function can be reserved; further, the data renewal (and reservation) frequency regarding the nonvolatile memory can be reduced.

The engine-speed detecting section 18 computes the speed of the engine 20 based on the frequency of the ignition pulses of the engine 20. To be more specific, an ignition pulse is detected during one revolution of the crankshaft of the engine (e.g. a single cylinder engine of two stroke cycle engine); thus, the engine speed (RPM speed) can be computed on the basis of the ignition frequency detected during one minute.

The throttle opening computing section 12 computes the deviation between the target engine speed determined by the target engine-speed determining section 16 and the detected engine speed computed by the engine-speed detecting section 18, so as to compute a throttle manipulation quantity (a correction variable) $\Delta\theta_{th}$. In the present mode, the throttle opening computing section 12 performs a PI control (a proportional integral feedback control).

A throttle opening regulating device 14 as shown in FIG. 1 regulates the throttle opening of the throttle valve 10 based on the throttle manipulation quantity $\Delta\theta_{th}$ that is computed in the throttle opening computing section 12.

As shown in FIG. 4, the throttle valve 10 is arranged in a suction air passage 34 in the carburetor 30; the flow rate of the suction air can be regulated by rotating the throttle valve (by controlling the throttle opening).

Incidentally, the carburetor 30 includes, but not limited to: the throttle valve 10, the suction air passage 34 forming a passage of the sucked air, a venturi part 36 being arranged on the lower surface side of the suction air passage 34, and a main nozzle 32 protruding from the venturi part 36.

The throttle opening regulating device 14 (the detail thereof is not depicted) is provided with an actuator for opening and closing the throttle. The type of the actuator is not limited to any special type; for instance, a stepping motor or a torque producing motor (a DC motor) may be used for the actuator.

In the following explanation of the invention, the actuator is to include the stepping motor that can control the rotation angle (i.e. the angular displacement) of the rotation shaft of the throttle valve.

Figure 5:
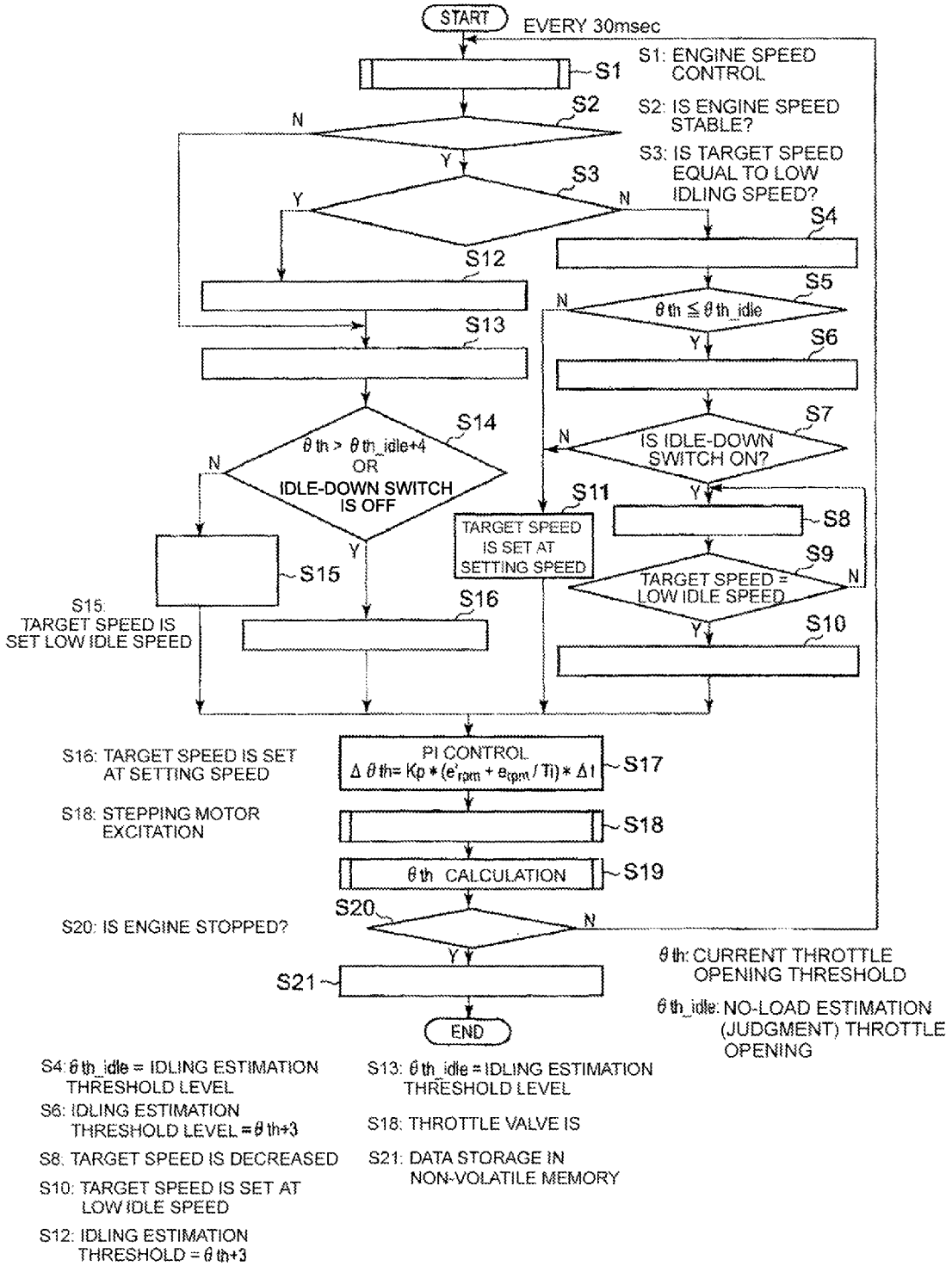
FIG. 5 shows a flow chart regarding an engine speed control according to the first mode of the present invention.

In the next place, an engine speed control method according to the this mode of the present invention is now explained; FIG. 5 is a flow chart for explaining the control procedures in controlling the engine speed by use of the engine speed control device as shown in FIG. 1.

In the engine-speed control according to the flow chart of FIG. 5, the target engine speed is loaded at first (the step S1). To be more specific, the target engine-speed computed by the setting engine-speed calculating section 2 (in FIG. 1) is loaded, the target engine-speed being the ordinary engine-speed or the setting engine-speed.

In the following step 2, it is judged whether or not the engine operation is stable at the target engine speed; thereby, if the speed deviations in the several renewals in the nearest previous data-change remain within N revolutions per minute, it is judged that the condition is stable. When the result of the judgment of the step 2 is affirmative, then the step S2 is followed by the step S3; when the result of the judgment of the step S2 is negative, then the step S2 is followed by the step S13.

In the step 3, it is judged whether or not the target engine speed is the low idle engine-speed; when the result of the judgment of the step S3 is affirmative, then the step S3 is followed by the step S12; when the result of the judgment of the step S3 is negative, then the step S3 is followed by the step S4.

When the result of the judgment of the step S3 is negative, namely, when the target engine speed is not the low idle engine-speed, then the farm working machine is placed not under no-load condition but under an ordinary operation condition.

In the step S4, a no-load estimation throttle opening threshold level $\theta_{th_idle}$ (cf. FIG. 2) stored in the memory section is recognized as an idling estimation threshold level in response to the setting engine speed.

In the step S5, it is judged whether or not the no-load estimation throttle opening threshold level $\theta_{th_idle}$ is greater than or equal to the current throttle opening threshold level $\theta_{th}$.

When the condition that $\theta_{th} \leq \theta_{th_idle}$ is not satisfied in the step S5, the step S5 is followed by the step S11 where the target engine-speed is kept at the setting engine-speed; then, the step S11 is followed by the step S17 where the PI control is performed and the engine continues the ordinary operation condition.

When the condition that $\theta_{th} \leq \theta_{th_idle}$ is satisfied in the step S5, it is judged that the farm working machine is driven in no load condition; and, the step S5 is followed by the step S6.

In the step S6, the current throttle opening threshold level $\theta_{th}$ is added by +3; the added result level is learned as the idling estimation threshold level in response to the setting engine speed; and, the no-load estimation throttle opening threshold level stored in the memory section is renewed.

Further, the value ($\alpha$) to be added to the current throttle opening threshold level $\theta_{th}$ is to be greater than the average deviation regarding the throttle openings; in this mode of the invention, the band width (the width of the fluctuation) of the throttle openings is assumed to be 2; and, the value ($\alpha$) to be added to the current throttle opening threshold level $\theta_{th}$ is set at +3 (i.e. the value $\alpha$=+3) so that the shift to the idling operation is appropriately started or stopped. Incidentally, the value $\alpha$ is assumed to be a positive integer (i.e. $\alpha>0$ and $\alpha$ is an integer).

In the following step S7, it is judged whether the idle-down switch is in an ON state or in an OFF state; when the idle-down switch is in OFF state in the step S7, the step S7 is followed by the step S11 where the target engine-speed is set at the setting engine-speed; then, the step S11 is followed by the step S17 where the PI control is performed and the engine continues the ordinary operation condition.

When the idle-down switch is in an ON state, the step S7 is followed by the step S8 whereby the idle-down can be started.

The ON and OFF states regarding the idle-down switch can be switched over from the OFF state to the ON state or vice versa, according to the intention of the machine operator regardless the judgment result of the step S5.

When the idle-down is started, the target engine speed is set at the low idle engine-speed; however, when the target engine speed is suddenly changed, the hunting or overshooting of the engine speed may be caused. Thus, the target engine-speed is gradually decreased in the step S8; and, the gradually-decreasing repetitions are continued until the target engine-speed reaches the low idle engine-speed in the step S9 (the steps 8 and 9 form a small repetition loop).

When it is confirmed in the step S9 that the target engine-speed finally reaches the low idle engine-speed, the step S9 is followed by the step S10.

In the step S10, the target engine speed is set at the low idle engine-speed; then, the step S10 is followed by the step S17 where the PI control is performed and the engine maintains an idling operation.

On the other hand, as described above, when it is judged in the step S3 that the target engine speed is equal to the low-idle engine speed, the step S3 is followed by the step S12; when the target engine speed is equal to the low-idle engine speed in the step S3, the engine is operated in an idling operation condition.

In the step S12, the current throttle opening threshold level $\theta_{th}$ is added by +3; the added result level is learned as the idling estimation threshold level at the low-idle engine-speed; and, the no-load estimation throttle opening threshold level (cf. FIG. 2) stored in the memory section is renewed. The value ($\alpha$) to be added to the current throttle opening threshold level $\theta_{th}$, is set at +3 (i.e. the value $\alpha$=+3). Hereby, it is assumed that the necessary conditions required for the learning renewals are satisfied; namely, the to-be-satisfied conditions are that the target engine speed is equal to the low-idle engine-speed and the target engine speed is stably realized.

When the throttle opening threshold level is renewed in the step S12, the step S12 is followed by the step S13.

In the step S13, the low-idle no-load estimation (use) throttle opening threshold level $\theta_{th_idle}$ to be stored in the memory section is recognized as an idling estimation threshold level at the low-idle engine-speed.

In the following step S14, it is judged whether or not the below conditions are satisfied:

$\theta_{th}>\theta_{th_idle}+4$, or the idle-down switch is at OFF state where $\theta_{th}$ is the current throttle opening threshold level, and $\theta_{th_idle}$ is the idling estimation threshold level.

Incidentally, the term +4 in the above judgment condition (the inequality) is the value $\beta$ to be added to the current throttle opening threshold level $\theta_{th}$. The value $\beta$ to be added to the current throttle opening threshold level $\theta_{th}$ is to be greater than the average deviation regarding the throttle openings, as is the case with the above-described value $\alpha$ to be added to the current throttle opening threshold level $\theta_{th}$; in this mode of the invention, in order that the idling operation is appropriately finished, the value $\beta$ to be added to the current throttle opening threshold level $\theta_{th}$ set at +4 (i.e. the value $\beta$=+4). Incidentally, the value $\alpha$ is assumed to be a positive integer (i.e. $\beta>0$).

When $\theta_{th}>\theta_{th_idle}+4$, or the idle-down switch is at OFF state in the step S14, then the step S14 is followed by the step S16 where the target engine speed is set at the setting engine-speed and the idling operation is finished; and, the step S16 is followed by the step S17 where the PI control is performed and the engine is returned to the ordinary operation condition.

In the step S14, when the inequality $\theta_{th}>\theta_{th_idle}+4$ is not satisfied and the idle-down switch is not at OFF state, then the step S14 is followed by the step S15 where target engine speed is set at the low idle engine-speed; the step S15 is followed by the step S17 where the PI control is performed and the engine maintains an idling operation.

In the step S17, the PI control is performed based on the established target engine speed.

To be more specific, the target engine-speed determining section computes and establishes the target engine-speed based on the outputs from the setting engine speed calculating section, the memory section and the idle-down switch; and, based on the target speed established by the engine-speed determining section, the throttle opening computing section computes the control order regarding the throttle manipulation quantity $\Delta\theta_{th}$ that is used for performing the PI control.

In the step S18 following the step S17, based on the throttle manipulation quantity $\Delta\theta_{th}$ computed in the step S17, the stepping motor is driven so that the opening of the throttle valve is increased or decreased.

When the throttle manipulation quantity $\Delta\theta_{th}$ is smaller than a certain level, the stepping motor performs the 1-2 phase excitation control; when the throttle manipulation quantity $\Delta\theta_{th}$ exceeds the level, the stepping motor performs the 2-phase excitation control. The 2-phase excitation control is used mainly while the engine-speed is increased or decreased.

In the step S18 following the step S17, the opening of the throttle valve (the throttle opening) is increased or decreased based on the throttle manipulation quantity $\Delta\theta_{th}$; then, the step S18 is followed by the step S19.

In the step S19, the throttle opening $\theta_{th}$ is computed; and the step S19 is followed by the step S20.

In the step S20, it is judged whether or not the engine is in a stopped condition.

If the engine is not in a stopped condition in the step S20, the step S20 is returned to the step S1; if the engine is in a stopped condition, the step S20 is followed by the step S21 where the operation data is loaded into the nonvolatile memory; more concretely, the renewed data regarding the throttle opening threshold that is learned and renewed in the steps S6 and S12 is memorized into the memory section. In this way, even when the accuracy regarding the no-load estimation is deteriorated by the secular change of the engine or the farm working machine, the accuracy regarding the no-load estimation is maintained. In other words, the accuracy deterioration is prevented and the accuracy is enhanced.

The data may be loaded into the nonvolatile memory when the idle-down manipulation is finished or at evenly spaced time intervals; however, since the frequencies of the data loading into the nonvolatile memory cannot exceed a certain level, it is desirable that the data may be loaded into the nonvolatile memory while the engine is stopped. In a case where the data is loaded while the engine is stopped, the number of the data loadings can be reduced so that the loading is efficiently performed.

As described thus far, according to the present mode of the invention, the no-load condition of the farm working machine 22 as shown in FIG. 1 can be estimated independently of the farm working machine 22; thus, an electric system for transferring signals between the engine 20 and the farm working machine 22 or a sensor for detecting the no-load condition can be dispensed with; and, the engine speed control device can be simply configured.

Further, based on the judgment of the no-load condition regarding the farm working machine, the target engine-speed is automatically changed and the opening of throttle valve 10 is regulated; thus, a loading operation of the engine can be automatically shifted to an idling condition. In other words, the operator can dispense with the idle-down manipulation for placing the engine in an idling operation condition; and, the efficiency of the operator can be enhanced.

(Second Mode)

In the next place, an engine control device as well as an engine control method according to a second mode of the present invention is explained.

Figure 6:
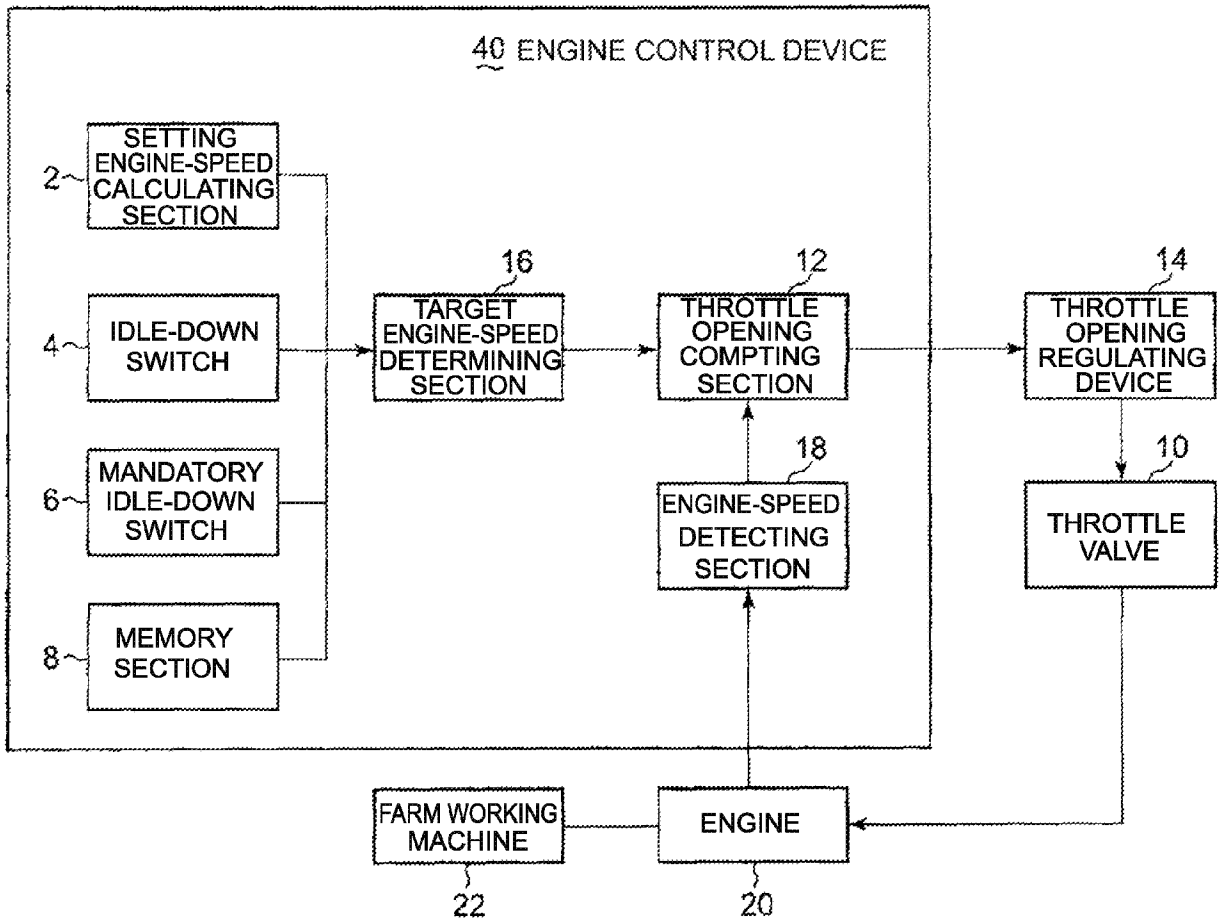
FIG. 6 shows a block diagram that depicts an engine speed control device according to a second mode of the present invention.
Figure 7:
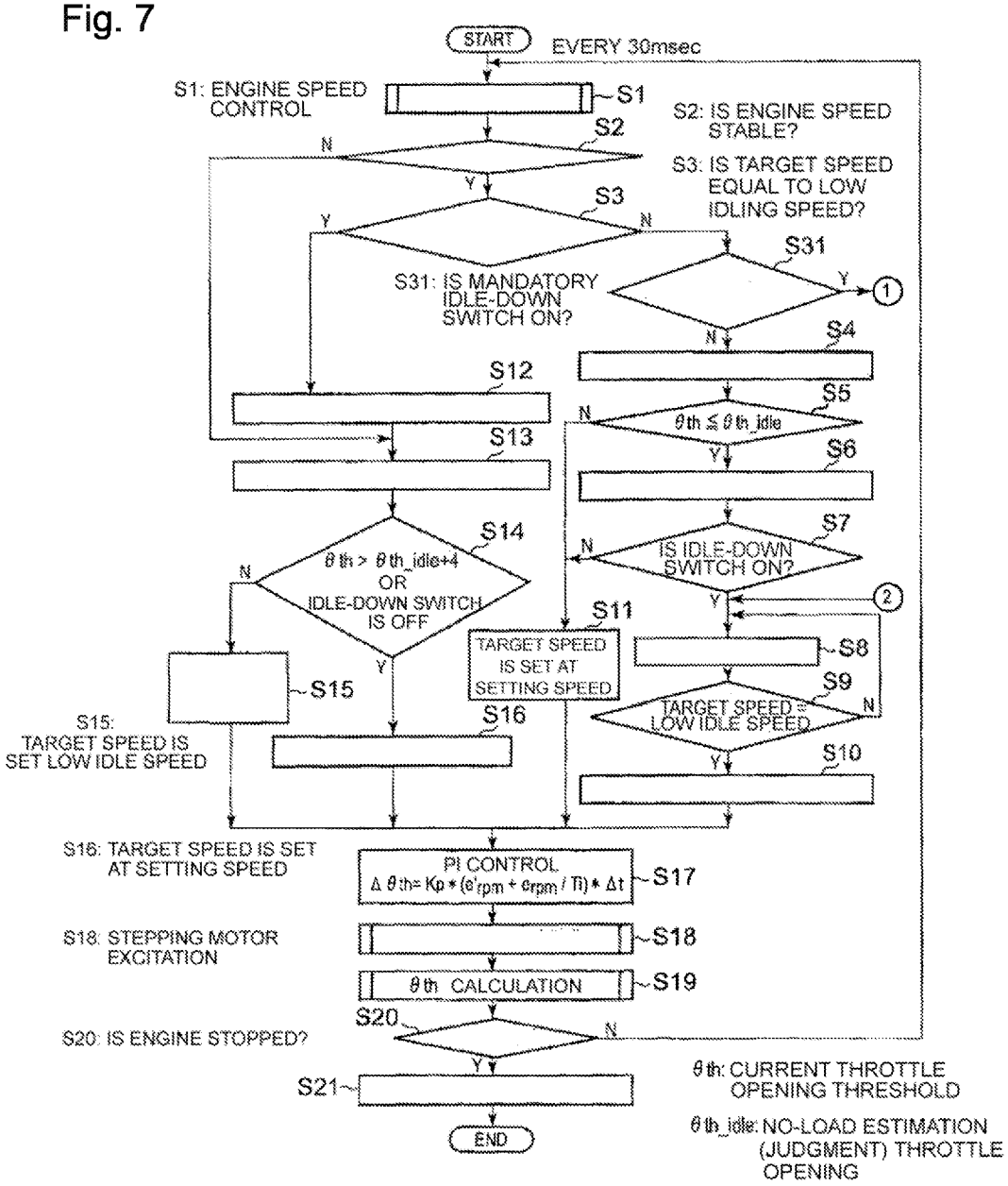
FIG. 7 shows a flow chart regarding an engine speed control according to the second mode of the present invention.
Figure 8:
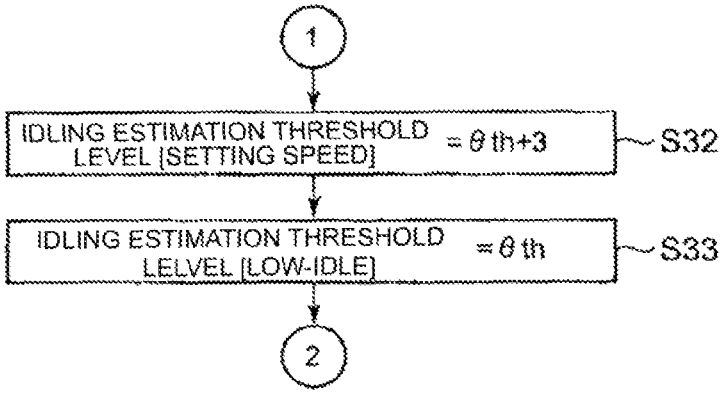
FIG. 8 shows a flow chart that explains a subroutine regarding the second mode of the present invention.

FIG. 6 shows a block diagram that depicts an engine speed control device according to the second mode of the present invention; FIG. 7 shows a flow chart regarding the engine speed control according to the second mode of the present invention; FIG. 8 shows a flow chart that explains a subroutine regarding the second mode of the present invention.

As shown in FIG. 6, an engine control device 40 according to this second mode is different from the engine control device 1 (cf. FIG. 1) in that the engine control device 40 is provided with a mandatory idle-down switch 6. The procedures of the engine speed control according to this mode are the same as the procedures explained by use of FIG. 5, except for the steps regarding the mandatory idle-down switch 6; hence, the explanation of the steps that are common in the first mode and this mode is hereby omitted.

In the engine-speed control according to the flow chart of FIG. 7, the target engine speed is loaded at first (Step 1). To be more specific, the target engine-speed computed by the setting engine-speed calculating section 2 (in FIG. 2) is loaded, the target engine-speed being the ordinary engine-speed or the setting engine-speed.

In the following step 2, it is judged whether or not the engine operation is stable at the target engine speed; thereby, if the speed deviations in the several renewals in the nearest previous data-change remain within N revolutions per minute, it is judged that the condition is stable. When the result of the judgment of the step 2 is affirmative, then the step S2 is followed by the step S3; when the result of the judgment of the step S2 is negative, then the step S2 is followed by the step S13.

In the step 3, it is judged whether or not the target engine speed is the low idle engine-speed; when the result of the judgment of the step S3 is affirmative, then the step S3 is followed by the step S12; when the result of the judgment of the step S3 is negative, then the step S3 is followed by the step S31.

When the result of the judgment of the step S3 is negative, namely, when the target engine speed is not the low idle engine-speed, then the farm working machine is placed not under no-load condition but under an ordinary operation condition.

However, in a case where the idling estimation threshold level at the low-idle engine-speed is excessively low, it may be arbitrary judged that the farm working machine is in a loading condition even just after the idling operation is started; thus, the idling operation is finished.

Thus, mandatory idle-down switch 6 is provided (FIG. 1) so that the idling estimation threshold level is rewritten and the idle-down is forcedly performed.

Further, in FIG. 6, the idle-down switch 4 and the mandatory idle-down switch are separately provided; however, the two switches may be integrated into one switch. When the two switches are integrated into one switch, the integrated switch may be manipulated in the different ways to perform the idle-down function and the mandatory idle-down function.

In performing the different functions, one function is corresponded to a continuous ON-OFF pulse form, and the other function is corresponded to a special pulse form; hereby, in order to make the special pulse pattern, it is supposed that the switch that is corresponded to the special pulse form is the idle-down switch 4; and, for instance, it is supposed that an OFF state of the idle-down switch 4 continues for a period exceeding 5 seconds; then, an OFF-ON-OFF-ON pulse within 2 seconds is produced so that the idle-down switch 4 is effective. Further, for instance, the special pulse form may be a pattern in which the idle-down switch 4 is pressed down for a certain long period of time.

In this way, both the functions of the idle-down switch 4 and the mandatory idle-down switch 6 are performed by the integrated idle-down switch.

The mandatory idle-down switch configured as described above judges whether the mandatory idle-down switch is in an ON state or an OFF state, in the step S31; if in an ON state, the step S31 is followed by the steps S32 and S33.

In the step S32, the current throttle opening threshold level $\theta_{th}$ is added by +3; the added result level is learned as the idling estimation threshold level in response to the setting engine speed; and, the no-load estimation throttle opening threshold level stored in the memory section is renewed.

In the step S32, the current throttle opening threshold level $\theta_{th}$ is learned as the idling estimation threshold level at the low-idle engine-speed; and, the no-load estimation (use) throttle opening threshold level (cf. FIG. 2) stored in the memory section is renewed.

In this way, the idle-down is forcedly performed.

Incidentally, as is the case with the first mode, the term +3 is the value $\alpha$ to be added to the current throttle opening threshold level $\theta_{th}$. The value $\alpha$ to be added to the current throttle opening threshold level $\theta_{th}$ is to be greater than the average deviation regarding the throttle openings.

After the thresholds are renewed in the steps 32 and 33, the step S33 is followed by the step S8 where the idle-down is being executed and the target engine-speed is gradually decreased. The step S8 is followed by the step S9 where it is judged whether or not the target engine-speed reaches the low idle engine-speed; the step 8 and the step S9 are repeated until the target engine-speed reaches the low idle engine-speed. When the target engine-speed reaches the low idle engine-speed becomes equal to the low idle engine-speed in the step S9, the step S9 is followed by the step S10.

In the step S10, the target engine-speed is set as the low idle engine speed; and, the step S10 is followed by the step S117 where the PI control is performed so that the idling operation of the engine is maintained.

On the other hand, when the judgment in the step S31 is negative, namely, when the mandatory idle-down switch is placed in an OFF state, the step S31 is followed by the step S4 where the idle-down commencement is automatically performed, as is the case with the first mode of the invention.

In the step S4, a no-load estimation throttle opening threshold level $\theta_{th_idle}$ (cf. FIG. 2) stored in the memory section is recognized as an idling estimation threshold level in response to the setting engine speed.

In the step S5, it is judged whether or not the no-load estimation throttle opening threshold level $\theta_{th_idle}$ is greater than or equal to the current throttle opening threshold level $\theta_{th}$.

When the condition that $\theta_{th} \leq \theta_{th_idle}$ is not satisfied in the step S5, the step S5 is followed by the step S11 where the target engine-speed is kept at the setting engine-speed; then, the step S11 is followed by the step S17 where the PI control is performed and the engine continues the ordinary operation condition.

When the condition that $\theta_{th} \leq \theta_{th_idle}$ is satisfied in the step S5, it is judged that the farm working machine is driven in no load condition; and, the step S5 is followed by the step S6.

In the step S6, the current throttle opening threshold level $\theta_{th}$ is added by +3; the added result level is learned as the idling estimation threshold level in response to the setting engine speed; and, the no-load estimation throttle opening threshold level stored in the memory section is renewed.

Further, the value ($\alpha$) to be added to the current throttle opening threshold level $\theta_{th}$ is to be greater than the average deviation regarding the throttle openings.

In the following step S7, it is judged whether the idle-down switch is in an ON state or in an OFF state; when the idle-down switch is in OFF state in the step S7, the step S7 is followed by the step S11 where the target engine-speed is set at the setting engine-speed; then, the step S11 is followed by the step S17 where the PI control is performed and the engine continues the ordinary operation condition.

When the idle-down switch is in an ON state, the step S7 is followed by the step S8 whereby the idle-down can be started.

The ON and OFF states regarding the idle-down switch can be switched over from the OFF state to the ON state or vice versa, according to the intention of the machine operator regardless the judgment result of the step S5.

When it is judged in the step S3 that the target engine speed is equal to the low-idle engine speed, the step S3 is followed by the steps S12 to S17; the execution processes hereby are the same as the execution processes in the steps S12 to S17 in the first mode; accordingly, the explanation repetitions are hereby omitted. In a similar vein, the execution processes in the steps S12 to S17 in this second mode are the same as those in the first mode; thus, the explanation repetitions regarding the steps S12 to S17 are also omitted.

As described above, according to the present mode of the invention, the no-load condition of the farm working machine 22 as shown in FIG. 6 can be estimated independently of the farm working machine 22; thus, an electric system for transferring signals between the engine 20 and the farm working machine 22 or a sensor for detecting the no-load condition can be dispensed with; and, the engine speed control device can be simply configured.

Further, based on the judgment of the no-load condition regarding the farm working machine, the target engine-speed is automatically changed and the opening of throttle valve 10 is regulated; thus, a loading operation of the engine can be automatically shifted to an idling condition. In other words, the operator can dispense with the idle-down manipulation for placing the engine in an idling operation condition; and, the efficiency of the operator can be enhanced.

Further, by use of the mandatory idle-down switch 6, the engine operation condition can be changed into an idling operation condition, not only automatically but also manually. In this way, even when the farm working machine initially shipped is replaced by another farm working machine, namely, when the demand torque from the farm working machine side is changed, the throttle opening threshold level in response to the engine speed can be manually renewed and re-established.

As described above, the modes according to the present invention are explained in detail. It goes without saying that these modes may be modified or improved in various ways, unless the improvement or the modification of these modes deviates from the points of the present invention.

For instance, a constant as the proportional gain $K_p$ or the integral action time $T_i$ may be appropriately changed depending upon the circumstances, although it is born in mind, in the above-described first or the second mode of the present invention, that the proportional gain $K_p$ or the integral action time $T_i$ a fixed constant.

To be more specific, differently from the case where the target engine speed is set at a setting engine speed (i.e. where the engine is operated in an ordinary operation condition) in the step S11, the proportional gain $K_p$ may be set with a smaller value in a case where the target engine speed is set at an idling engine speed (i.e. where the engine is operated in a low idle operation condition) in the steps S10 and S15. Thus, a stable PI control can be performed and the engine stall due to the abrupt throttle manipulation can be prevented.

Further, differently from the case where the target engine speed is set at a setting engine speed (i.e. where the engine is operated in an ordinary operation condition) in the step S11, the proportional gain $K_p$ may be set with a greater value in a case where the target engine speed is set at a setting engine speed (i.e. where the low idle operation condition is changed into an ordinary operation condition) in the step S16. Thus, the speedy response performance of the PI control can be enhanced, and the deviation of the actual engine speed from the target engine speed can be got closer to zero.

The invention claimed is:

1. An engine speed control device for driving a farm working machine, the engine speed control device comprising:

a memory device in which a throttle opening threshold level corresponding to a target engine speed is memorized;

a first judgment device which reads out the throttle opening threshold level corresponding to the target engine speed from the memory device, and judges whether or not a current throttle opening threshold level is smaller than or equal to the throttle opening threshold level corresponding to the target engine speed;

a target engine speed changing device by which the target engine speed diminishes to a low idling engine speed in a case where the first judgment device judges that the current throttle opening threshold level is smaller than or equal to the throttle opening threshold level corresponding to the target engine speed; and a throttle opening regulating device which regulates an opening of an throttle valve based on the target engine speed.

2. The engine speed control device according to claim 1, the engine speed control device further comprising a first learning device which updates the throttle opening threshold level corresponding to the target engine speed in a case where the first judgment device judges that the current throttle opening threshold level is smaller than or equal to the throttle opening threshold level corresponding to the target engine speed, so that the throttle opening threshold level corresponding to the target engine speed is replaced by the level which is obtained by adding a value greater than an average deviation of throttle opening levels to the current throttle opening threshold level.

3. The engine speed control device according to claim 1, wherein the throttle opening threshold level which is obtained in a case where the target engine speed becomes equal to the low idling engine speed is set as a second throttle opening threshold level, and the engine speed control device further comprises a second judgment device which judges whether or not the current throttle opening threshold level is greater than or equal to the level which is obtained by adding a value greater than an average deviation of throttle opening levels to the second throttle opening threshold level, and wherein the target engine speed changing device makes the target engine speed increase in a case where the second judgment device judges that the current throttle opening threshold level is greater than or equal to the level which is obtained by adding a value greater than an average deviation of throttle opening levels to the second throttle opening threshold level.

4. The engine speed control device according to claim 1, the engine speed control device further comprising:

a switch which inputs whether or not the farm working machine is in a no-load condition; and a second learning device which, in a case where the no-load condition is inputted by the switch, updates the throttle opening threshold level corresponding to the target engine speed to the level which is obtained by adding a value greater than an average deviation of throttle opening levels to the current throttle opening threshold level, and updates the second throttle opening threshold level to the current throttle opening threshold level.

5. The engine speed control device according to claim 1, wherein the memory device is a volatile memory, whereas the engine speed control device is provided with a nonvolatile memory which memories the throttle opening threshold levels corresponding to the target engine speed and the second throttle opening threshold levels.

6. An engine provided with the engine speed control device according to claim 1.

7. An engine speed control method for driving a farm working machine, the engine speed control method comprising the steps of:

performing a memorizing process in which a throttle opening threshold level corresponding to a target engine speed is previously memorized in a memory device;

performing a first judgment process in which the throttle opening threshold level corresponding to the target engine speed is read-out from the memory device, and it is judged whether or not a current throttle opening threshold level is smaller than or equal to the throttle opening threshold level corresponding to the target engine speed;

performing a first target engine speed changing process in which the target engine speed diminishes to a low idling engine speed in a case where it is judged, in the first judgment process, that the current throttle opening threshold level is smaller than or equal to the throttle opening threshold level corresponding to the target engine speed; and performing a throttle opening regulating process in which an opening of the throttle valve is regulated based on the target engine speed.

8. The engine speed control method according to claim 7, the engine speed control method further comprising the steps of performing a first learning process in which the throttle opening threshold level corresponding to the target engine speed is updated in a case where it is judged, in the first judgment process, that the current throttle opening threshold level is smaller than or equal to the throttle opening threshold level corresponding to the target engine speed, so that the throttle opening threshold level corresponding to the target engine speed is replaced by the level that is obtained by adding a value greater than an average deviation of throttle opening levels to the current throttle opening threshold level.

9. The engine speed control method according to claim 7, the engine speed control method comprising the steps of:

performing a second judgment process in which the throttle opening threshold level which is obtained in a case where the target engine speed becomes equal to the low idling engine speed is set as a second throttle opening threshold level, and it is judged whether the current throttle opening threshold level is greater than or equal to the level which is obtained by adding a value greater than an average deviation of throttle opening levels to the second throttle opening threshold level; and in the second judgment process, the target engine speed is increased in a case where it is judged, that the current throttle opening threshold level is greater than or equal to the level that is obtained by adding a value greater than an average deviation of throttle opening levels to the second throttle opening threshold level.

10. The engine speed control method according to claim 7, wherein the farm working machine comprises a switch which inputs whether or not the farm working machine is in a no-load condition, performing the second learning process in which, in a case where no-load condition is inputted by the switch, the throttle opening threshold level corresponding to the target engine speed is updated to the level which is obtained by adding a value greater than an average deviation of throttle opening levels to the current throttle opening threshold level, and the second throttle opening threshold level is updated to the current throttle opening threshold level.

11. The engine speed control method according to claim 7, in the memorizing process, the throttle opening threshold level corresponding to a target engine speeds is memorized by using a volatile memory; and the throttle opening threshold levels corresponding to the target engine speed and the second throttle opening threshold levels are memorized by using a nonvolatile memory elements different from the volatile memory.

* * * * *